US011724209B2

(12) United States Patent
Spitzer et al.

(10) Patent No.: US 11,724,209 B2
(45) Date of Patent: Aug. 15, 2023

(54) BABY TOY BELT

(71) Applicants: David Spitzer, Brooklyn, NY (US); Lipa Spitzer, Brooklyn, NY (US)

(72) Inventors: David Spitzer, Brooklyn, NY (US); Lipa Spitzer, Brooklyn, NY (US)

( * ) Notice: Subject to any disclaimer, the term of this patent is extended or adjusted under 35 U.S.C. 154(b) by 0 days.

(21) Appl. No.: 16/866,471

(22) Filed: May 4, 2020

(65) Prior Publication Data

US 2021/0016196 A1 Jan. 21, 2021

Related U.S. Application Data

(63) Continuation-in-part of application No. 16/687,897, filed on Nov. 19, 2019, now abandoned.

(60) Provisional application No. 62/770,523, filed on Nov. 21, 2018.

(51) Int. Cl.
*A63H 33/00* (2006.01)

(52) U.S. Cl.
CPC ..... *A63H 33/006* (2013.01)

(58) Field of Classification Search
CPC ..... A63H 33/00; A63H 33/006; A47D 5/00; A47D 15/00; A47D 15/005; A47D 15/008
USPC ..... 446/26, 28, 227
See application file for complete search history.

(56) References Cited

U.S. PATENT DOCUMENTS 2,846,700 A * 8/1958 De Puy ..... A47D 15/008 5/655
2,858,641 A * 11/1958 Trimble ..... A63H 33/006 108/29
2,888,263 A * 5/1959 Ruhmann ..... A63G 17/00 446/26
3,085,610 A * 4/1963 Vardan ..... A63H 33/006 206/526
3,184,883 A * 5/1965 McCook ..... A63H 33/006 446/28
3,493,228 A * 2/1970 Hicks ..... A47D 13/08 5/655
4,068,313 A * 1/1978 Goldman ..... A41B 13/10 2/49.1
4,205,669 A * 6/1980 Hamann ..... A61F 5/3769 5/621
4,540,219 A * 9/1985 Klinger ..... B60N 2/286 297/487
4,661,072 A * 4/1987 White ..... A63H 33/00 434/260
4,685,599 A * 8/1987 Israel ..... G04B 37/1433 968/351

(Continued)

*Primary Examiner* — Alexander R Niconovich
(74) *Attorney, Agent, or Firm* — Israel Nissenbaum; Yitzy Nissenbaum

(57) ABSTRACT

A toy belt for stimulation and distraction of a baby during diapering. The belt includes a soft plush elongated belt element configured to snugly encircle and be fastened around a waist of the baby with engaged end fastening elements of hook and eye sections. The belt element has an outward surface section, when the heft is positioned on a stomach of the baby, having plush and hard pull toy elements which are capable of being manually manipulated by the baby are fixedly fastened. The belt and the toy elements are configured to be positioned on the baby whereby they do not interfere with diapering and feeding the baby. The toy belt further contains imbedded lighting and music elements activated by external compression switches.

7 Claims, 2 Drawing Sheets

(56) References Cited

U.S. PATENT DOCUMENTS 4,722,713 A * 2/1988 Williams ..... A63H 33/006 248/102
4,723,323 A * 2/1988 Wright, Jr. ..... G09B 19/0076 2/244
5,046,980 A * 9/1991 Tai ..... A41B 13/10 446/73
5,309,926 A * 5/1994 Mayton ..... A47D 5/00 128/869
5,465,888 A * 11/1995 Owens ..... A45F 3/00 224/663
5,484,316 A * 1/1996 Poirier ..... A63H 5/00 446/28
5,546,620 A * 8/1996 Matthews ..... A47D 13/08 5/639
5,702,039 A * 12/1997 Olaiz ..... B62B 3/1456 24/3.13
5,730,340 A * 3/1998 Bosic ..... A45F 5/02 224/684
5,815,834 A * 10/1998 Bronson ..... A41B 13/10 2/102
5,950,888 A * 9/1999 Nolan-Brown ..... A47D 15/00 224/172
6,009,874 A * 1/2000 Sartin ..... A47D 5/00 5/655
6,224,450 B1 * 5/2001 Norton ..... B62J 1/16 446/28
RE38,393 E * 1/2004 Bronson ..... A41B 13/10 2/102
6,694,520 B2 * 2/2004 Smith ..... A41D 13/04 2/48
6,810,545 B1 * 11/2004 Darling ..... A47D 13/08 5/655
6,854,142 B2 * 2/2005 Lukomskiy ..... A47D 15/008 5/655
6,966,472 B2 * 11/2005 Szarek ..... A63H 33/006 446/28
7,013,493 B2 * 3/2006 Briscoe ..... A41D 15/005 2/247
7,104,861 B2 * 9/2006 Kanahele ..... A63H 33/006 446/28
7,624,461 B2 * 12/2009 Tidwell ..... A47D 15/003 5/655
8,695,137 B1 * 4/2014 Hanson ..... A47D 5/00 5/655
8,696,400 B2 * 4/2014 Fair ..... B62B 5/082 24/581.1
9,089,169 B1 * 7/2015 Covo ..... A41D 1/04
9,764,247 B2 * 9/2017 Sinclair-Nitschke ..... A63H 33/006
9,776,098 B2 * 10/2017 Fair ..... A63H 33/006
10,307,686 B2 * 6/2019 Bearsch ..... G03B 29/00
10,362,884 B1 * 7/2019 Gibson ..... A41B 13/106
10,966,545 B2 * 4/2021 Mastrosimone-Gese ..... A63H 33/006
2002/0042953 A1 * 4/2002 Matthews Brown .. A47D 13/08 5/655
2002/0124297 A1 * 9/2002 Caris ..... A63H 33/006 446/227
2004/0060116 A1 * 4/2004 Matthews Brown ..... A47D 13/083 5/636
2005/0172411 A1 * 8/2005 Snedeker ..... A47D 15/008 5/655
2006/0183397 A1 * 8/2006 Kanahele ..... A63H 33/006 446/26
2011/0300771 A1 * 12/2011 DeForest ..... A63H 33/006 446/28
2012/0276805 A1 * 11/2012 Muscarella ..... A63H 33/006 446/227
2013/0055483 A1 * 3/2013 Moreno ..... A41B 13/10 2/102
2017/0112295 A1 * 4/2017 McConnell ..... A47D 5/00
2017/0112296 A1 * 4/2017 McConnell ..... A47D 15/00
2017/0224127 A1 * 8/2017 Kerem ..... A47D 5/00
2018/0132599 A1 * 5/2018 Djesevic ..... A63H 33/006
2021/0401189 A1 * 12/2021 Yang ..... A47D 1/004

* cited by examiner

BABY TOY BELT

FIELD OF THE INVENTION

This invention relates to baby garments with integrated toy elements and relates particularly to a plush belt garment with non-removable integrated toy elements.

BACKGROUND

Babies or infants are often in need of stimulation or distraction and an industry has been developed around providing stimulation toys for babies or infants. This is in contrast to the toys for older children and toddlers such as games and building blocks.

Stimulation toys are often in the form of crib mobiles or soft plush figures or animals placed in or on cribs which the baby or infant can watch or actually manipulate. Some plush toys are adapted for placement within cribs adjacent to the baby or infant for manual manipulation. Stringent guidelines are required for such toys to permit them for placement in cribs and they cannot present any choking or concussive hazards with small or hard elements or components. Some plush toys and other objects such as pacifiers have in the past been removably attached to the clothing (such as bibs or vests) of both the care givers for the baby or infant or to garments worn directly by the baby or infant in the form of short (to avoid dangerous entanglements) tethers. These have been cumbersome with safety considerations of removable elements.

In addition, babies or infants, generally up to about six months of age are squirmy and are difficult to hold in position during diaper changes and often require some sort of distraction in the form of a personal interaction device or toy.

SUMMARY OF THE INVENTION

It is an object of the invention to provide a stimulation toy for a baby or infant which is of minimal dimension which is fixed into an anchored position relative to the baby or infant in a position adjacent to and convenient to hands of the baby or infant.

It is a further object of the invention to provide plush or other soft fabric material toys and other stimulation toy elements anchored to a plush belt with the belt being readily deployed and removable. In order to enhance interest of the baby or infant, the toys are of different colors, shapes and grasping sensations It is yet another object of the invention to provide the toy elements with safely embedded light and sound effects triggered by manual manipulation of the baby or infant with batteries for power imbedded either within the toy elements or within the belt.

It is still another object of the invention to provide a fixed position toy which provides a distraction of the baby or infant to engage the baby's attention to minimize squirming movement during diapering procedures.

Generally, the present invention comprises a toy belt configured for stimulation and/distraction of a baby during diapering and a method using the toy belt for stimulation and distraction, particularly during diapering procedures. The belt comprises a soft plush elongated belt element configured to snugly encircle and be fastened around a waist of the baby with engaged end fastening elements. The belt element has an outward surface section, when the belt is positioned on a stomach of the baby, to which one or more manually manipulable toy elements of plush form and hard pull form are fixedly fastened ("fixedly" being defined as not being capable of being removed by the baby). The belt and the fixedly fastened toy elements, are positioned on the baby in a form and position which does not interfere with diapering and feeding the baby. In embodiments, the toy elements or the belt element further contain lighting and or music elements activated by soft compression switches on the toy elements.

The plush or soft belt is supplied with readily deployable and undoable fasteners such as hooks and eyes and clips and manually manipulable plush toy elements extending from one side of the belt and non-removably or strongly fastened thereto). In an embodiment, the belt is about two to three inches in width (or a width sufficient to support the extending plush toy elements) and about two feet in total length (though other shorter and longer lengths are also feasible) and is comprised of a toy supporting section of about one foot in length and a belt portion of about one foot in length, configured to be positioned underneath the baby or infant. The hook and eye fastener are respectively positioned at the ends of the belt with each being about several inches in length to permit ready deployment and length variation to accommodate different waist sizes. If snap fasteners are utilized they should be arranged with multiple snaps or catches to provide the requisite waist variations. The fastening elements are arranged to extend to the sides of the baby or infant for ready engagement and disengagement. It is understood that the length parameters are variable within reasonable utilization limits and are not otherwise limiting.

The stimulation toy elements are combinations of differently colored plush or soft manipulable elements such as geometric shapes or animals with optional hard plastic grasping rings such as circular and square rings and plush extending tendrils, with all of the elements, rings and tendrils being strongly fastened to each other or to the plush belt in a non removable manner such as with a sewn connection or with connections that are not releasable by baby or infant manipulations.

In an embodiment, the plush elements are provided with soft switches and with contained replaceable batteries within the plush element and which are not accessible to the baby or infant. Hard surfaces thereof are cushioned with the plush of the plush elements. The soft switches are positioned such that manual manipulation causes them to be activated with elements such as the tendril ends being lighted and the plush elements emitting timed music.

With the effect of stimulation, the attention of the baby is distracted with the various features of soft touch, colors, shapes, manipulation capability, sounds and light afforded by the belt in a fixed proximate position relative to the baby's hands and face yet distanced from excessive if any mouth ingestion. It is understood that the belt and the toy elements thereon present no sharp or possibly harmful hard surfaces and that all materials are non toxic and present no possible choking or other unacceptable hazards The above objects, features and advantages of the invention are more readily evident from the following drawings in which:

SHORT DESCRIPTION OF THE DRAWINGS

DETAILED DESCRIPTION

Figure 1:
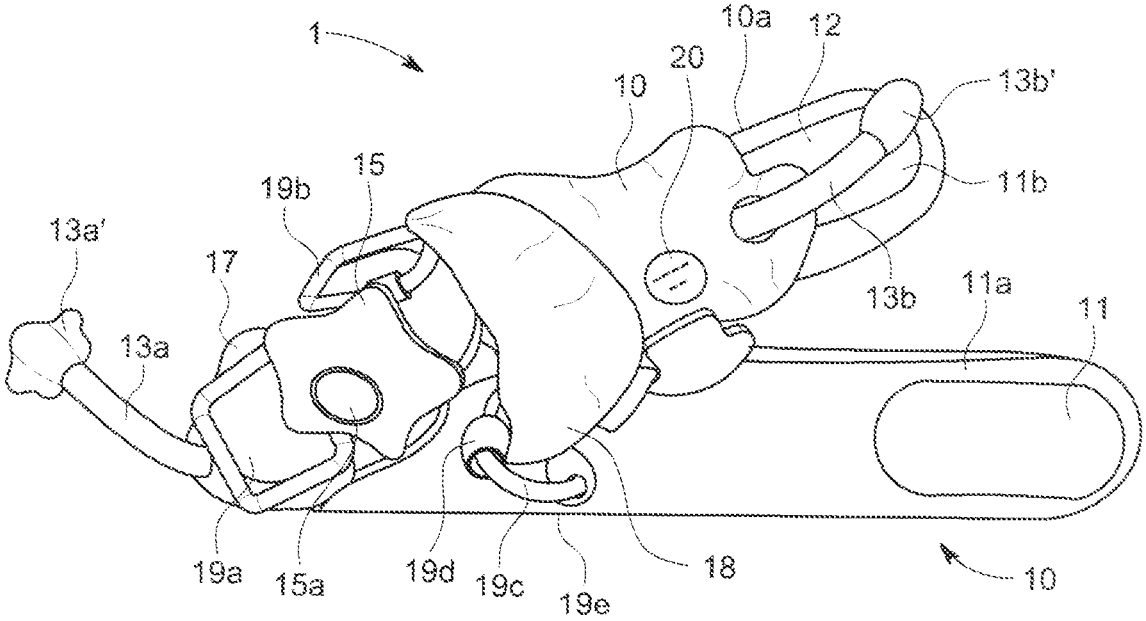
FIG. 1 is a front view of the belt of the invention in a folded configuration showing plush toy attachments and part of the rear.
Figure 2:
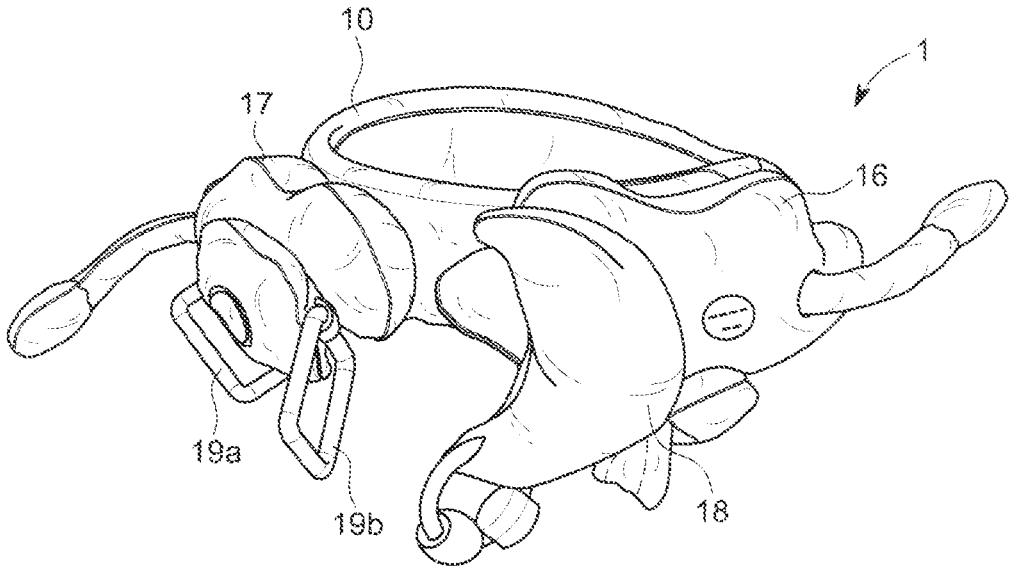
FIG. 2 is a view of the belt of FIG. 1 in an view enclosing configuration.
Figure 3:
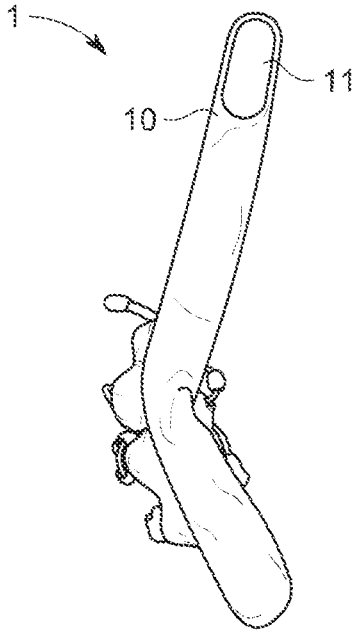
FIG. 3 is a full rear view of the belt of FIG. 1.
Figure 4:
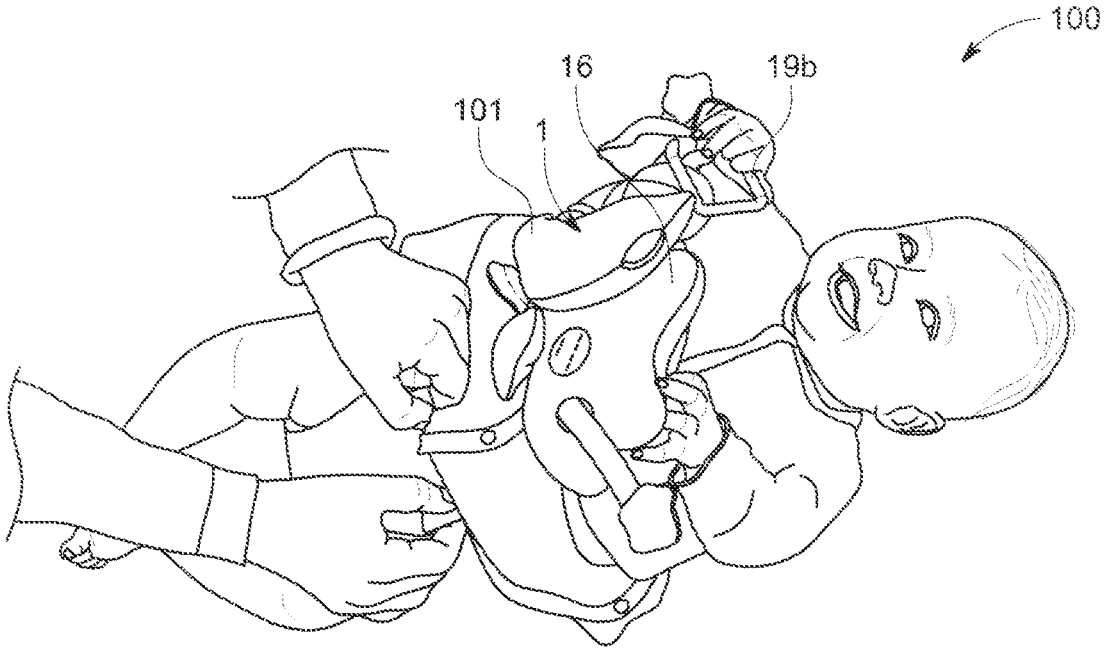
FIG. 4 is a view of the belt of FIG. 1 as placed and positioned on a baby.

With respect to the Figures, belt structure 1, comprises an elongated belt element, 10 having hook and eye elements 11 and 12, is of a dimension sufficient to snugly surround the waist 101 of a baby 100 shown in FIG. 4. The hook and eye elements 11 and 12, located on obverse end sections 11*a* and 12*a* of the belt element 10 whereby they provide a fastened encircling structure as shown in FIG. 2. The hook and eye elements 11 and 12 are of sufficient respective lengths along the length of the belt 10 whereby they permit attachment adjustment round a baby's waist for a snug fit. The attachment is situated behind the baby where it is not reachable for possible disengagement by the baby.

Plush toy elements are affixed to one side surface of belt section 10*a* with connections which are either relatively non-removable or are of sufficient connective strength to resist any removal thereof from the belt by the baby. The plush elements extend primarily along the length of the belt 10 without excessive lateral extension from the belt edges whereby they do not interfere with diapering of the baby on the lower side and with feeding of the baby on the upper side (when positioned on the baby) and the plush elements are all within reach of the baby to permit stimulative manipulation and/or effective manipulation distraction. As seen in the figures, a series of plush elements are longitudinally arranged with some stacking of elements. The plush elements are of varying shapes and colors.

Soft purple plush element 17, with an amorphous bone type configuration is fixedly positioned on belt section 10*a*, starting from about the midpoint of belt 10. Plush orange stalk 13*a* topped with a yellow end 13*a*' extends upwardly from plush element 17. A second red stalk 13*b* with yellow end 13*b*' extends from large orange plush pillow element 16. Plush green star 15 with yellow button 15*a* is fixedly positioned on plush bone 17. Yellow plush crescent 18 is affixed to an end of pillow 16. Hard plastic yellow and green grasping rectangles 19*a* and 19*b* are affixed to and extend from green star 15. Yellow hard plastic grasping ring 19*c* with loose purple and rings 19*d* and 19*e* extend from the end of crescent 18.

As shown, pillow element has a push control 20, which when pressed, activates an imbedded music chip contained therein with associated battery as well as light elements contained in the yellow stalk end 13*a*' and 13*b*' which plays for a short period of time.

Baby 100 is shown in FIG. 4 as happily grasping rectangle grasping element 19*b* as well as pillow 16 while being diapered.

It is understood that specific elements on the belt including fastening elements and arrangements may vary in shape, configuration, color and arrangement without departing from the scope of the invention as defined in the following claims.

What is claimed is:

1. A flexible toy belt garment configured for stimulation and distraction of a baby during diapering, the flexible toy belt garment comprising:

a) a soft plush elongated flexible belt element having a substantially uniform thickness along its entire length with the thickness being sufficiently thin to enable winding around a waist of the baby, an elongated length sufficient to enable it to be wrapped completely around the waist of the baby, and the belt element further comprising engageable fastening elements at longitudinal opposite ends of the belt element; the flexible belt being configured to be placed against the waist of the baby in an elongated configuration and then flexibly wound around the waist of the baby to snugly encircle and be fastened around a waist of the baby, with engaged end fastening elements holding the belt element on the baby as a belt garment;

b) the flexible belt element having an outward and upward facing surface section, when the belt is positioned on a stomach of the baby, to which at least one toy element is directly non-removably fastened, with the at least one toy element having dimensions and shape enabling it to be laterally viewable by the baby, in a face up lying position, as a toy element;

c) the at least one toy element is directly non-removably fixedly fastened to the outward and upward facing surface section, wherein the at least one toy element is reachable and manually manipulable by the baby from an upper side of the flexible toy belt, and d) wherein the directly non-removably fixedly fastened at least one toy element, is configured to be positioned directly on the flexible belt element in a form and position which does not interfere with diapering and feeding the baby, when the flexible toy belt is positioned on the baby, and does not extend to impede reaching either a mouth or a diapering area of the baby.

2. The flexible toy belt garment of claim 1, wherein the engaged end fastening elements are comprised of respective hook and eye segment elements positioned on obverse end surfaces of the elongated flexible belt element.

3. The flexible toy belt garment of claim 1, wherein the at least one manually manipulated toy element, fixedly fastened to the outward and upward facing surface section of the flexible belt element, comprises any or all of plush light stalks, soft squeezable elements, and hard pull elements of varying shapes and colors.

4. The flexible toy belt garment of claim 3, wherein plush toy elements are:

vertically affixed to other toy elements and wherein hard pull elements extend from at least one plush toy element.

5. The flexible toy belt garment of claim 4, wherein plush material of any or all of the plush toy elements is comprised of polyester fibers.

6. The flexible toy belt garment of claim 4, wherein one or more of the plush toy elements comprises an externally accessible press switch which:

activates, for short duration, lighting elements in one or more plush elements and music chips in one or more of the plush toy elements.

7. The flexible toy belt garment of claim 1, wherein a width of the elongated flexible belt element is up to three inches, and sufficient to support the toy elements thereon.

* * * * *